United States Patent [19]

Schenkel et al.

[11] Patent Number: 4,939,816

[45] Date of Patent: Jul. 10, 1990

[54] CONTROL APPARATUS FOR CONTROLLING FLOCK HEIGHT IN A FEED CHUTE FOR A FIBER PROCESSING MACHINE

[75] Inventors: Thomas Schenkel, Effretikon; Urs Staehli, Turbenthal, both of Switzerland

[73] Assignee: Rieter Machine Works, Ltd., Winterthur, Switzerland

[21] Appl. No.: 181,074

[22] Filed: Apr. 13, 1988

[30] Foreign Application Priority Data

Apr. 13, 1987 [CH] Switzerland ..... 01455/87

[51] Int. Cl.[5] ..... D01G 23/06

[52] U.S. Cl. ..... 19/105; 19/240; 73/293; 340/619; 222/56; 406/23; 406/31

[58] Field of Search ..... 222/56; 406/23, 31; 340/612, 619; 250/573, 577; 221/9, 14; 137/386, 391, 393; 73/290, 293; 116/227, 71; 19/105, 106 R, 240

[56] References Cited

U.S. PATENT DOCUMENTS

| | | | |
|---|---|---|---|
| 3,242,794 | 3/1966 | Crane | 340/619 X |
| 3,712,203 | 1/1973 | Kishi et al. | 340/619 X |
| 4,133,454 | 1/1979 | Arthur et al. | 222/56 |
| 4,286,464 | 9/1981 | Tauber et al. | 340/619 X |
| 4,321,732 | 3/1982 | Erben | 19/240 |
| 4,378,897 | 4/1983 | Kaftelman | 222/56 |
| 4,396,911 | 8/1983 | Motsinger et al. | 340/619 X |
| 4,535,511 | 8/1985 | Leifeld | 19/105 |
| 4,657,444 | 4/1987 | Pinto | 19/105 |
| 4,745,929 | 5/1988 | Silver | 250/577 |
| 4,776,066 | 10/1988 | Leifeld | 19/105 |
| 4,779,311 | 10/1988 | Leifeld | 19/105 |

FOREIGN PATENT DOCUMENTS

| | | |
|---|---|---|
| 0175851 | 4/1986 | European Pat. Off. . |
| 2050111 | 9/1970 | Fed. Rep. of Germany . |
| 2658044 | 6/1979 | Fed. Rep. of Germany . |
| 2834586 | 2/1983 | Fed. Rep. of Germany . |
| 1405043 | 5/1965 | France . |
| 2524500 | 10/1983 | France . |
| 275186 | 3/1986 | Switzerland . |
| 0973662 | 10/1964 | United Kingdom . |

*Primary Examiner*—Andrew M. Falik
*Attorney, Agent, or Firm*—Kenyon & Kenyon

[57] ABSTRACT

A control unit maintains the fiber flock column in a feed chute at a set height. The control unit includes a row of light barriers located about a set height for emitting signals in response to interruption of the light barriers by fiber flock. An evaluation unit evaluates the signals to determine the actual height of the flock column and emits a control signal to adjust the feed rollers in the feed chute.

29 Claims, 8 Drawing Sheets

Figure 1:
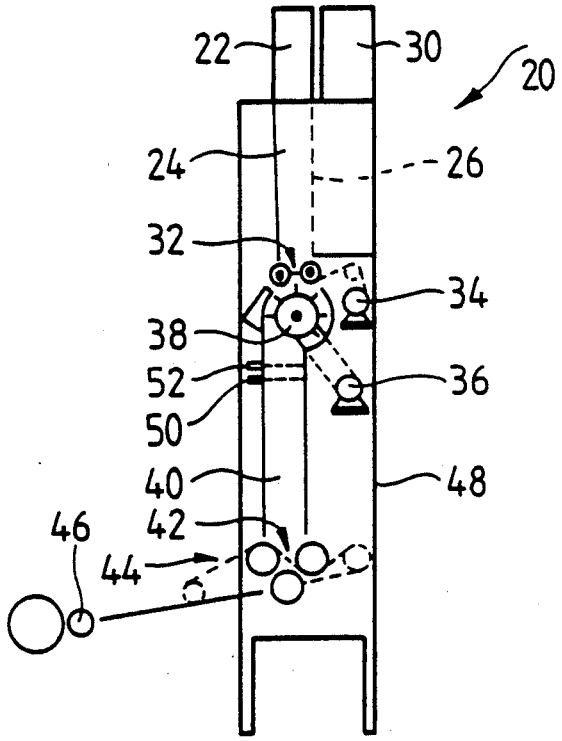

CONTROL APPARATUS FOR CONTROLLING FLOCK HEIGHT IN A FEED CHUTE FOR A FIBER PROCESSING MACHINE

This invention relates to a feed chute for a fiber processing machine. More particularly, this invention relates to a method for controlling the height of a fiber column in a feed chute.

For some time, feedchutes for fiber processing machines, e.g. a card or a cleaning machine in the blowroom of a short staple spinning-mill, have been known with variants of these devices being described in European Patent Application No. 175851 and Swiss Patent Application No. 2751/86. The mode of operation of a chute of this type is explained in the article "the new card-feed device aerofeed-U" by R. Waeber and U. Stahli in the February 1986 edition of "mittex". As shown in that article, the height of a flock- or fiber column is to be monitored and controlled by two light barrier devices arranged one above the other. The required production of the installation must be set by the operating personnel. The two light barrier devices operate in conjunction with a feed roll drive, which is designed to operate at a relatively rapid rate upon operation of the lower light barrier and at a relatively slow rate upon operation of the upper light barrier. The feed roller feeds flocks from an infeed chute portion into a main chute portion.

In principle, this arrangement should enable a continuous flow of fibers from the infeed cute portion into the main chute portion. However, in practice, it often happens that the production set by the operating personnel is too high, so that the relatively slow operating rate is still too rapid and the delivery of flocks into the main chute portion has to be stopped by an overfill safety device, i.e. the transfer of flocks into the main chute portion is carried out discontinuously. This is known to be undesirable and leads to strong impacts on the feed-forming material column (compressions).

An arrangement for continuous delivery of fibers or flocks into a feed chute is known from German patent specification No. 2834586 and U.S. Pat. No. 4,321,732. In accordance with this arrangement, however, it is not the height of the fiber column which is controlled but the pressure in the main feed chute portion, as also is the case in German patent specification No. 2658044 (equivalent—U.S. 4,404,710) and in German patent specification No. 1510302 (FIG. 4). Since the mode of operation of the regulating device has not been completely described in German patent specification No. 2834586, it is not possible to determine from that specification how the system is intended to operate as a whole. From later publications of the patent owner in the textile specialist press, it appears to be necessary, however, to feed an additional regulating quantity (a manually entered set value or an indication of the basic rate of revolutions derived from a card feed) into the regulating circuit in order to obtain the desired constant pressure in the main feed chute portion.

Accordingly, it is an object of the invention to provide a simple reliable technique for controlling the height of a fiber flock column in a feed chute.

It is another object of the invention to maintain a level of a fiber flock column at or near a predetermined set height within a feed chute.

It is another object of the invention to monitor and control the height of a flock column in an efficient manner.

Briefly, the invention provides a feed chute for a fiber processing machine including an infeed chute for receiving fiber flocks, a forwarding means for forwarding fiber flocks therefrom and a main chute for forming a flock column of the forwarded fiber flocks with a control unit for controlling the forwarding means in dependence upon the flock column in the main chute.

The control means includes first means for defining a set height of the fiber column in the main chute and a second means for determining the magnitude of a deviation of the actual fiber column height from the set height. This second means is connected to the forwarding means to control the forwarding means in response to the determined magnitude of deviation to eliminate the deviation.

In a second aspect, the invention relates to a measuring member for determining the level of a flowable material. In this aspect, the invention is not limited to use in connection with a feed chute for fiber material.

The measuring member is characterized by a row of sensors, each of which is capable of detecting the presence of a flowable material in a predetermined operating region of the sensor. In addition, the member includes a sampling or interrogation means to interrogate the sensors as to whether material is present in their operating regions or not. A predetermined sensor in the row can then represent in operation a set value for the level. Furthermore, by means of the determination as to which sensors are reacting to the presence of material in their operating regions and which sensors are not so reacting, the actual material level can be derived. A possible instantaneous deviation of the actual level from the set height is thus indicated by the distance between the actual level and the sensor representing the set height.

The spacing between each two adjacent sensors can be equal along the row, but in a preferred variant, this spacing is made smaller in the region of the sensor representing the set value and larger in zones further spaced from the set value. This latter arrangement enables a more exact determination of level and possibly also a smaller "level hysteresis" in the neighborhood of the set value, while the complete row of sensors still covers a sufficiently large range of levels without requiring a large number of sensors (with corresponding auxiliary devices as will subsequently be described). The number of sensors in the row will be dependent upon the conditions of operation, but for a feed chute of a fiber processing machine, six to ten sensors will normally fulfill the requirements.

The sensors can be light barriers. Each light barrier can either be in the form of a one-way barrier (without a reflector) or a two-way barrier (with a reflector). The sensors can be switched either singly or in groups in sampling to determine the presence of material in the respective operating regions, so that cross talk between the sensors is avoided. Sequential switching of the sensors can be controlled from a sampling device.

The sampling device can be so arranged that it regularly repeats a predetermined sampling cycle, each sensor being sampled within each cycle. The results for each cycle are then delivered to an evaluation unit where a possible deviation of the instantaneous level from the set level is determined. The value of this deviation is made available to the regulator in the form of a suitable signal.

The means for determining the magnitude of a deviation may be in the form of an evaluation unit which can be so arranged to react in a different manner to a change of level in one direction as indicated by the sensors than to a change of level in the other direction as indicated by the sensors. For example, the evaluation unit can be so arranged, under predetermined circumstances, to pass on immediately and completely an "apparent" change of level in the one direction (e.g. downwardly), while passing on an "apparent" change of level in the other direction (e.g. upwardly) only after a delay and/or to a degree which is reduced to a predetermined extent. This enables a reduction in "deceptive effects".

If the row of sensors is considered from bottom to top, the first sensor which indicates absence of material in its operating range can be taken as definitive for the apparent actual level.

In combination with a feed chute, a signal representing the deviation can be processed by a regulating unit according to a predetermined regulating function in order to generate an output signal delivered by the regulating unit. This variable output signal can serve to indicate a set value for a further regulating unit which directly regulates the forwarding means. As in the case of German patent specification No. 2834586, a feed roller (or a feed roller pair) can serve as a forwarding means for flocks stored in a feed chute portion. The regulating unit can then regulate the rotation rate of the feed roller.

Advantageously, the regulating function is variable in dependence upon the level of a detected deviation between the set and actual heights of the fiber column. The complete measuring region defined by the height measuring device can, for example, be divided into two or more (advantageously four) zones, a respective regulating function being defined for each zone. Advantageously, each regulating function is a so-called PI-function.

By way of example, several embodiments in accordance with the invention will now be described in greater detail with reference to the drawings. All figures are diagrammatic.

Figure 2:
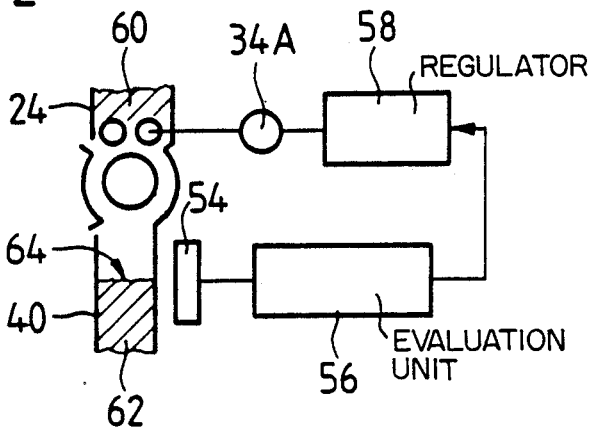
Figure 3:
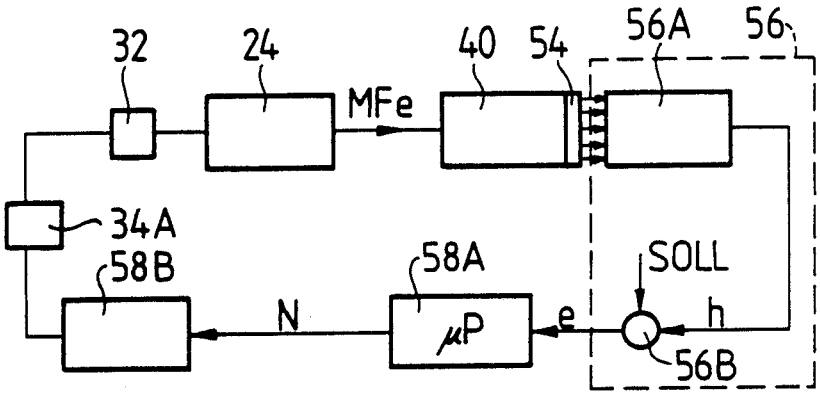
Figure 4B:
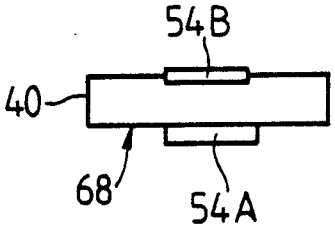
Figure 4A:
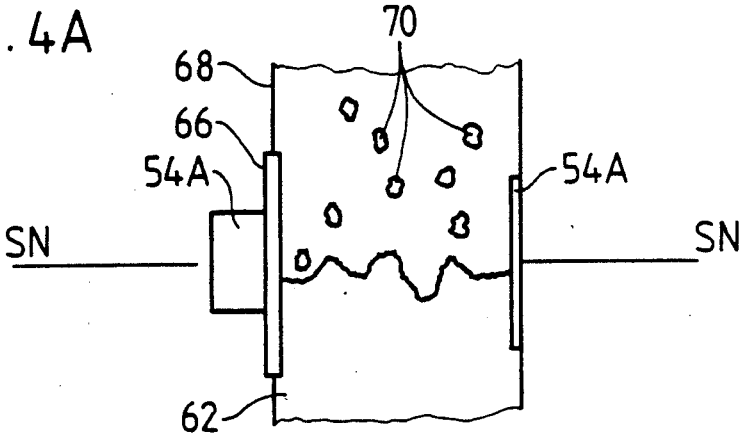
Figure 5:
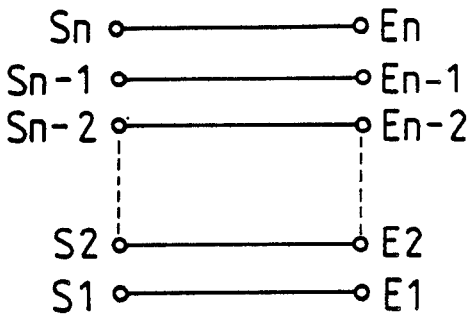
Figure 8:
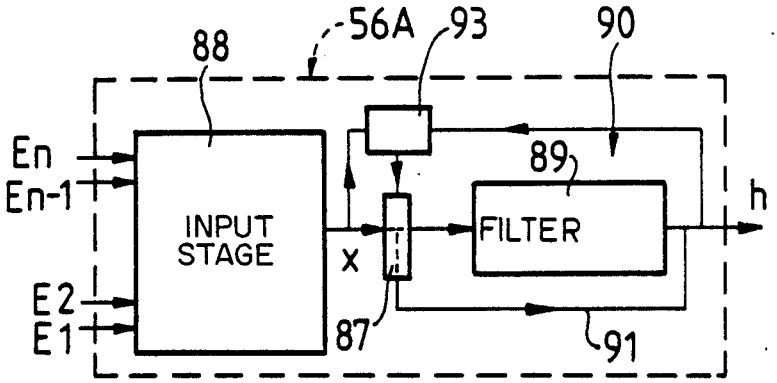
Figure 6:
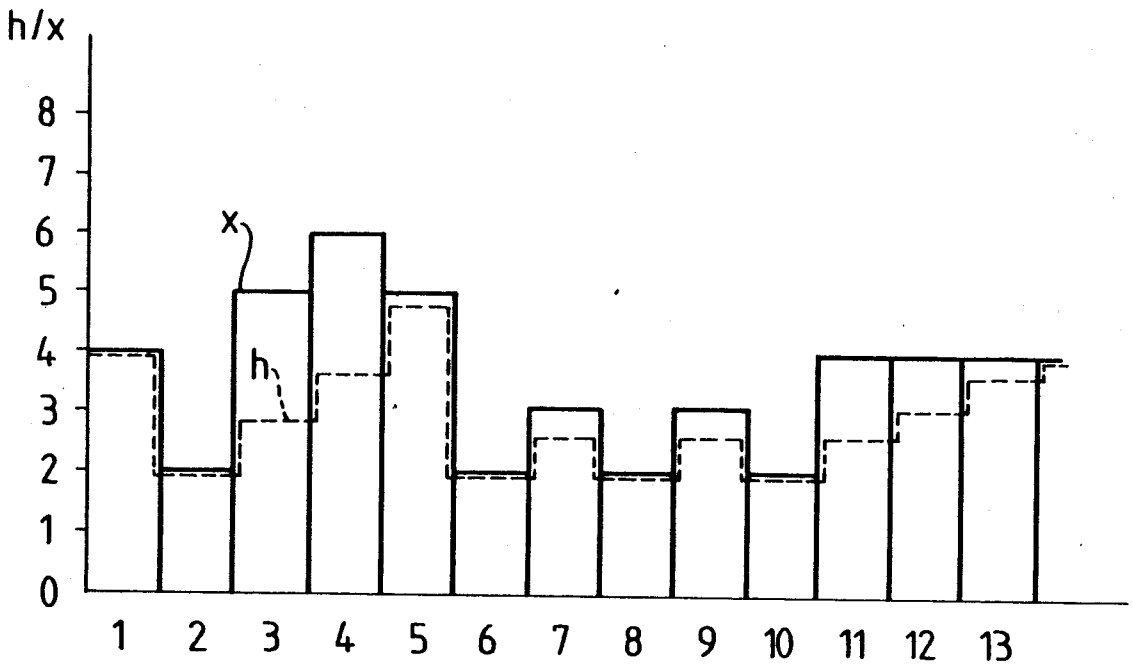
Figure 7:
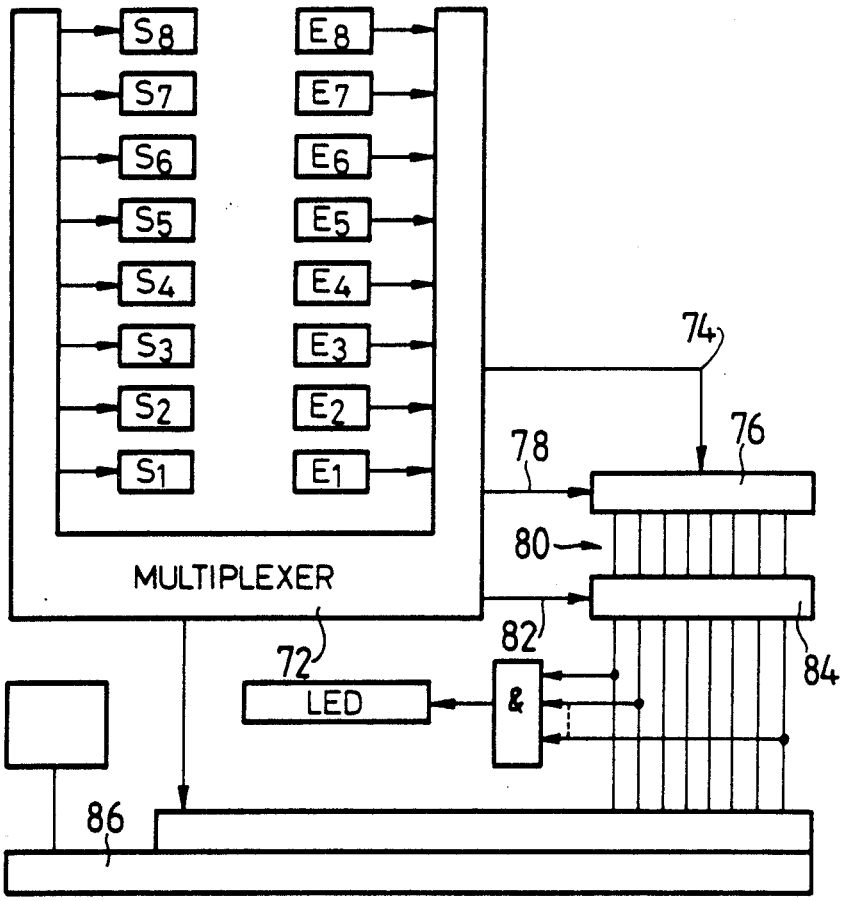
Figure 9:
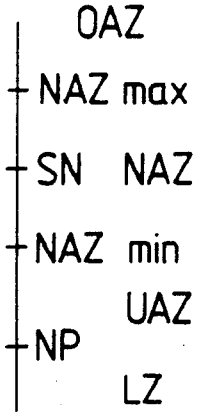
Figure 12:
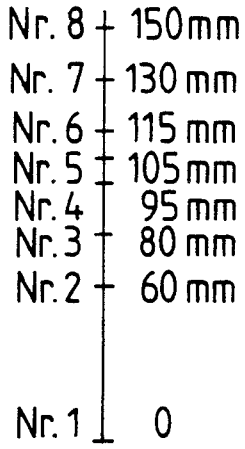
Figure 11:
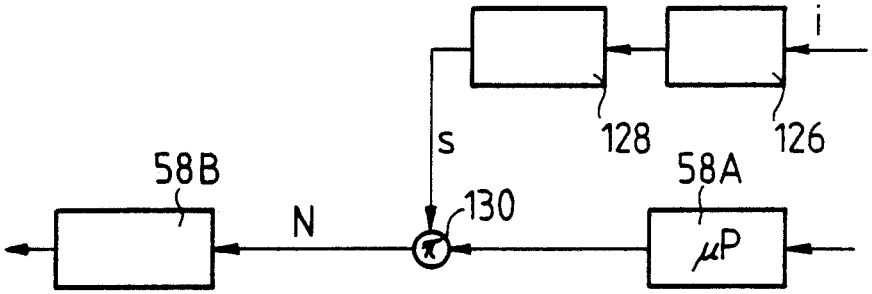
Figure 10:
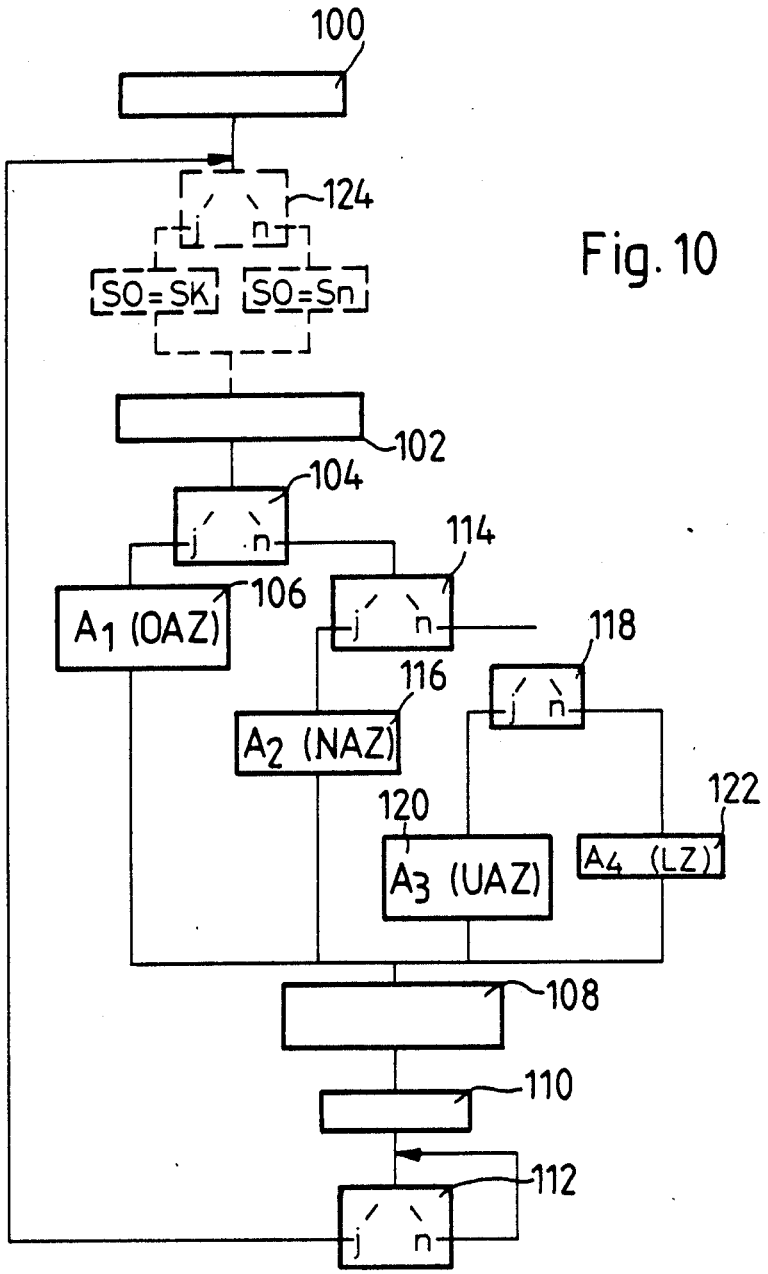
Figure 13:
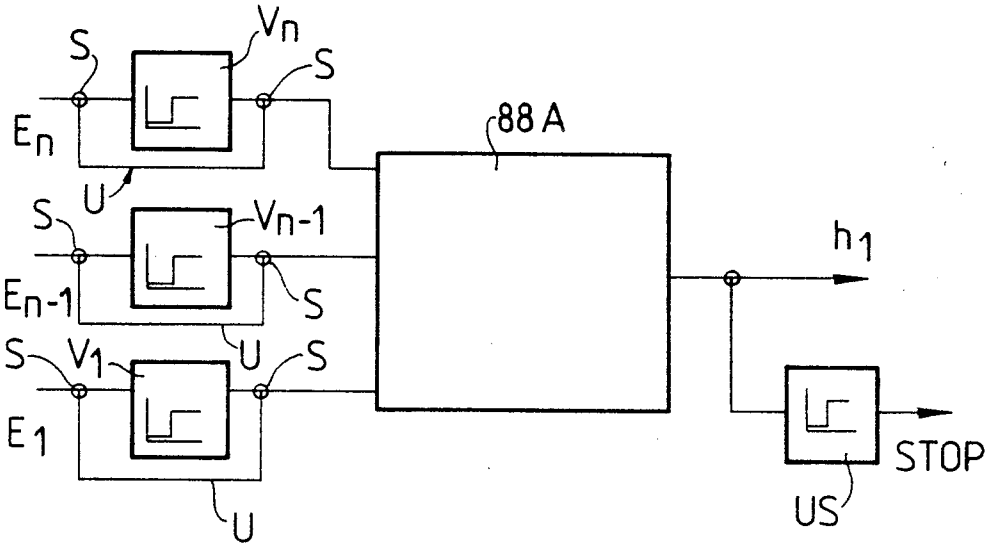

FIG. 1 shows a side view of a feed chute in accordance with the state of the art, FIG. 2 shows a modification of the chute on FIG. 1 so that the modified chute can operate in accordance with this invention, FIG. 3 shows a block diagram of the regulating circuit laid out in accordance with the modification illustrated in FIG. 2, FIG. 4A shows a side view of part of the chute of FIG. 2 with a fiber column formed therein and a height measuring member for determining the height of this column, FIG. 4B shows a cross section of the chute of FIG. 4A, FIG. 5 shows an arrangement of sensors of a height measuring member, FIG. 6 shows a diagram for explaining a proposed method for determining the height of the column by means of the arrangement in accordance with FIG. 5, FIG. 7 shows a block circuit diagram of a height measuring member, FIG. 8 shows an evaluation unit for evaluating output signals of the height measuring member, FIG. 9 shows a diagram for explaining an imaginary division of the measuring region covered by height measuring member, FIG. 10 is a sequence diagram for the regulator illustrated in FIG. 3, FIG. 11 is a diagram of a possible variant of the regulating circuit, FIG. 12 is a diagram for explaining the preferred arrangement of sensors in the height measuring member; and FIG. 13 illustrates a bypass arrangement for the signals from the sensors to an evaluation unit.

Referring to FIG. 1, the feed chute 20 is constructed as explained in detail in the previously mentioned "mitex" publication. In operation, fiber flocks are delivered to the chute 20 from preceding machines in a blow room line by a non-illustrated pneumatic feed duct. Flocks are extracted from this duct in an extractor head 22 so that, together with the transport air, they flow downwardly in a so-called infeed chute 24. One wall 26 of the infeed chute is formed by a perforated sheet so that the transport air can flow away through this wall 26 into a plenum chamber 28 and from there into an exhaust housing 30. The flocks themselves cannot pass through the perforations of the perforated sheet and form a batt (not shown) in the infeed chute 24 above the feed roller pair 32.

The feed rollers 32 can be driven by a motor 34 in order to deliver material from the batt formed in the infeed chute 24 to an opening roller 38 driven by a motor 36. The infeed chute therefore acts as a reserve-forming chute while the rollers 32, 38 define a forwarding means for forwarding the fiber flocks from the chute 24.

Material forwarded by the feed rollers 32 and opening roller 38 falls in the form of small flocks or as individual fibers into a so-called main chute portion 40 where it forms a fiber or flock column (not shown) above a withdrawal roller pair 42. Material from the lower end of this non-illustrated column can be delivered by a withdrawal assembly 44 comprising the rollers 42 and passed to a feed cylinder 46 of a non-illustrated card. Although the feed chute 20 illustrated in FIG. 1 is specifically designed for card feeding, a substantially identical chute can be used to feed fiber material to other machines in a blow room line. For this purpose, the chute portions are supported in the already described arrangement in a housing 48.

A lower light barrier 50 and an upper light barrier 52 are provided in this known arrangement to regulate the column height in the main chute portion 40. The intended mode of operation of these light barriers in cooperation with the motor 34 is well known so that no further description is necessary.

Referring to FIG. 2, wherein like reference characters indicate like parts as above, the drive motor 34A for the feed roller pair 32 must enable a continuous speed regulation instead of the simple switching between slow and rapid operation in the arrangement in accordance with FIG. 1. In place of the light barriers 50, 52, a height measuring member 54 is provided and will subsequently be described in greater detail. This member 54 delivers an output signal to an evaluation unit 56. A regulator 58 receives output signals from the evaluation unit 56 and reacts thereto in order to control the speed of the motor 34A. Accordingly, the member 54 unit 56 and regulator 58 define a control unit or means having a closed regulating loop in the form illustrated in FIG. 3.

The regulating length of the closed loop comprises the infeed chute 24 with the lower end of the batt 60 (FIG. 2) and the main chute portion 40 with the fiber or flock column 62 (FIG. 2). The height, i.e. the position of the uppermost surface 64 of the column 62 in the main chute portion 40 is intended to be regulated. A flow of material MFa takes place from the lower end of the chute 40 and this cannot be influenced by the closed regulating loop itself. A material flow MFe takes place between the infeed chute 24 and the main chute 40. This material flow occurs within the closed loop and can be controlled by that loop by an adjusting device (i.e. by the adjusting element in the form of the feed roller pair 32 together with the adjusting drive in the form of the motor 34A). By regulating the material flow MFe, the column height in the main chute 40 is to be maintained constant as far as possible.

The detecting device of the closed loop is formed by the height measuring member 54 mounted directly on the main chute 40 together with the associated signal evaluation unit 56. The evaluation unit 56 comprises a first unit 56A which delivers a signal h representing the instantaneous actual column height (the column level) and a second unit 56B which compares this detected height with a predetermined set height to generate a signal e representing any possible height deviation.

The regulator 58 in FIG. 2 is formed in the example of FIG. 3 by two elements, namely by a microprocessor 58A and a motor regulator 58B. The latter must be adapted to the motor 34A and for that purpose can be of a commonly known construction so that no further description is necessary here. The microprocessor 58A processes the signal e in accordance with a predetermined control algorithm in order to deliver a signal n representing a set value for the motor controller 58B.

The division of this closed loop into various elements, especially as regards the evaluation unit 56 and the microprocessor 58A, has been carried out in part at least for the purpose of a complete description. In practice, modern electronics enable various operations to be performed by a single structure element (chip).

HEIGHT OR LEVEL MEASUREMENT

Examples of a height measuring device for use in a chute arrangement in accordance with FIG. 2 will now be described with reference to FIG. 4 to 7. As a first step, the position of the height measuring device relative to the main chute 40 will be explained with reference to FIG. 4, and simultaneously this description will clarify various requirements placed upon the device itself.

As shown in FIGS. 4A and 4B the main chute 40 mounts the height measuring member 54 approximately in the center of one longitudinal side of the rectangular section. The member 54 contains a row of sensors, each of which in this example has been illustrated as a light barrier. In the illustrated example, each light barrier is in the form of a two-way device, with a sender/receiver unit in a housing 54A on one side of the chute 40 and a reflector 54B on the opposite chute side. The light barriers of the member 54 could be formed as one-way devices, so that each comprises a sender element on one chute side and a receiver element on the opposite chute side, the reflector 54B then being unnecessary.

The housing 54A in FIG. 4A is mounted on a transparent sheet 66 and the latter is fitted in the side wall 68 of the chute so that the light beams of the barriers can be transmitted transverse to the breadth of the chute up to the reflector 54B. As subsequently explained in greater detail in connection with FIGS. 5 to 7, the individual sensors (not illustrated) are arranged in a vertical row. A predetermined position within this row (advantageously approximately half way between the upper and lower ends of the row) represents a set level SN. Advantageously, this set level SN is spaced as far as possible from the withdrawal roller 42 (FIG. 1) to give the largest possible column height, without risking overfilling of the chute 40 up to the opening roller 38. A suitable spacing between the set level SN and the envelope surface of the opening roller 38 lies in the range 200 to 300mm, the envelope surface containing all of the rotating parts of the opening roller 38 (including the clothing thereof).

The set level SN can be defined unambiguously. The determination of the actual level (represented in FIG. 2 in a simple manner by the surface 64) is a relatively complicated operation which necessitates a derivation procedure. Certain problems of this derivation can be recognized from the representation of the fiber column 62 in FIG. 4A and the schematic representation of newly arriving flocks 70.

As schematically illustrated in FIG. 4A, the uppermost surface of the column 62 is never in the form of a horizontal plane, and newly arriving flocks 70 will normally be present above this column surface and simultaneously within the overall measurement range of the height measurement device 54. Therefore, member 54 cannot sense an "exact" or "absolute" actual level (because no such level exists) and, secondly, possible "deceptive effects" must be taken into account, these "deceptive effects" being caused by newly arriving flocks present in the neighborhood of the column surface.

A suitable method for overcoming these difficulties will now be explained in greater detail with reference to the diagrams of FIG. 5 and 6.

FIG. 5 shows a vertical row of n sensors, successively numbered from bottom to top. For purposes of clear representation, each sensor has been illustrated as a one-way light barrier with respective transmitter elements S1 to Sn and corresponding receiver elements E1 to En. FIG. 5 shows the two lower light barriers 1 and 2 and the three upper light barriers n-2 to n. The set height or set level SN (FIG. 4A) lies somewhere between the barriers 2 and n-2. The fiber column should, therefore, normally block access to the receivers E1 and E2 relative to the correspondingly arranged transmitters S1 and S2, but should leave the receivers EN-2 to EN free with respect to the correspondingly arranged transmitters SN-2 to Sn. However, as already indicated in connection with FIG. 4A, one or the other or both light beams of these upper light barriers can be interrupted by newly arriving fiber flocks 70 (FIG. 4A).

For each sensor, an imaginary "operating zone" is defined by the path of the light beams from the transmitter to the receiver (of the same sensor). If flocks are present in this "operating zone" the light beam will be interrupted. The sensors can be interrogated continuously or at desired intervals in respect of their respective "conditions", i.e. whether the respective light beams are interrupted (condition-covered) or not (condition-free). In an interrogation procedure of this type, the column height must lie somewhere below the operating region of the first free light beam considered from the lower end of the row. The position of the neighboring, lower, covered sensor can be designated as the "apparent" actual level.

Assuming that the light barriers are not interrogated continuously but sequentially (in accordance with a repeatable interrogation cycle) as to their respective conditions, then for each interrogation cycle a certain "apparent" level can be derived by evaluation of the output signals from the light barriers. Possible results of such an evaluation have been represented by the bar diagrams in FIG. 6 for thirteen successive interrogation cycles. In this diagram, each bar represents the result of an interrogation cycle and the bar heights give the number of light barriers, viewed from the lower end from the row, covered by the fiber material, i.e. between the lower end of the row and the first free light barrier. The vertical axis of the bar diagram is correspondingly divided in accordance with the sensor numbering, even spacings being assumed between neighboring sensors.

As subsequently explained in greater detail, the column height derived by the evaluation is not necessarily made equal to the apparent column height represented by the bar height. The processing of the height signals within the evaluation unit depends upon the direction of possible height changes. The resulting derived column heights are indicated in FIG. 6 by the dotted lines.

For reasons of simplicity, it will be assumed that in the first interrogation cycle in FIG. 6, the derived value is equal to the apparent value. In the given example, these values have been placed at four "units" (covered sensors considered from the bottom end of the row). In the second interrogation cycle, the apparent value drops to two units. From consideration of FIGS. 4A and 5, it will be apparent that the actual level cannot under any circumstances lie above the apparent level. Accordingly, in the second interrogation cycle the derived level is again equal to the apparent level.

In the third interrogation cycle, the apparent level rises to five units. From consideration of FIGS. 4A and 5 it will be clear that the actual level could well lie below the apparent level, so that an increase in the apparent level between two successive interrogation cycles can not immediately be accepted as "valid". The evaluation unit therefor passes on an increase, but not to the full value, but to a degree reduced in accordance with a predetermined function. Accordingly, in FIG. 6, the bar diagram and the dotted lines separate correspondingly during the third interrogation cycle. In accordance with the dotted line, a column height of three units has been derived.

In the fourth interrogation cycle, the apparent level moves still further upwardly and this causes a further increase in the dotted line (and a corresponding derived value for the column height). In a fifth cycle, the apparent level comes down slightly again, without however permitting the bar diagram and the dotted lines to merge once again. The latter occurs in the sixth interrogation cycle, when the apparent level once again falls below the derived level. The realization of this step will subsequently be described in connection with FIG. 8.

Interrogation cycles 7 to 10 show that periodic small variations in the column height in the upward direction are not passed on by the evaluation unit in practice, because they are "smoothed out" by the delay arising from the derivation function As shown by the last three interrogation cycles in FIG. 6, the apparent value is overtaken by the derived value after a certain time delay if it remains at a raised level.

FIG. 6 shows that a step- or stair-shaped increase of the signal at the input to the evaluation unit effects a step-shaped increase in the derived level (represented by the signal h). As subsequently explained in further detail, this result can be effected by a digital low-pass filter, the filter characteristic being so adjusted that a step-shaped increase in the input signal only appears to its full effect in the derived level after a predetermined number of interrogation cycles (time delay) - in FIG. 6, after four interrogation cycles (see cycles 11, 12 and 13). Accordingly, while the signal x can take on only discrete values (corresponding to the number of sensors) the signal h can take any value because of the intervening filtering operation.

FIG. 7 shows further details of a height measuring device which can operate in accordance with the system described in connection with FIGS. 5 and 6. The device comprises eight one-way light barriers with transmitters S1 to S8 and corresponding respective receivers E1 to E8. The light barriers are disposed in a multiplexer 72 of an interrogation device so that they are switched in succession with each light barrier being switched once in a single interrogation cycle. The period of the interrogation cycle is so short that movements of still falling flocks can be ignored within an interrogation interval. The light barriers are switched in succession in order to eliminate mutual influences. In the event that such mutual influences can be avoided in another manner, i.e. by suitable modulation of the light signals or by color filtering, the light barriers can be switched at least in groups or even switched on continuously. In the given example, the interrogation interval is determined by the multiplexer 72. In the event of simultaneous switching, an interrogation interval could be determined in another manner, i.e. by a suitable clock signal.

During a specific interrogation interval, the condition signals of the receivers E1 to E8 are read into a shift register 76 of the interrogation device via data lead 74, the read-in operation being controlled by signals on a trigger lead 78 from the multiplexer 72. At the end of the interrogation interval, therefore, data relating to all eight receiver conditions is available at the outputs 80 of the shift register 76. By means of a suitable strobe signal on the lead 82, reading out of the condition data can be carried out by an output gate 84, so that the corresponding information can be passed on to the evaluation unit 56A (FIG. 3) via a plug connector 86 (FIG. 7).

EVALUATION UNIT

The evaluation unit 56A is illustrated again schematically in FIG. 8, the mode of illustration being selected less for purposes of representing reality than for explanation of the operations carried out. Unit 56A comprises an input stage 88 which receives the data from a shift register 76 (FIG. 7). From this data, the unit 56A determines the apparent level by detecting the number of light barriers between the lower end of the row and the first free light barrier; a corresponding signal x is delivered to an output stage 90.

The signal x can therefore take discrete values between 0 and 8. For the input stage 88, therefore, the lower end of the row, i.e. sensor no. 1 (and not the set height) serves as a reference level, everything beneath this reference level being considered as "0". Signal x therefore corresponds to the distance between this reference level and the lowermost position within the measurement range at which no material can be detected, i.e. if sensor 1 itself is not detecting any material, than signal x remains at "0". In general, signal x corresponds to the number (L-1) where L is the number of the first free light barrier from the lower end of the row.

The output stage 90 processes the signal x to an output signal h, the type of processing being dependent upon the development of the signal x over time (upon its "history").

In the example illustrated in FIG. 8, two "processing methods" are foreseen:

1. direct transmission of the signal x (unchanged) as signal h,
2. low pass filtering of the signal x and transmission of the filtered signal as the signal h.

In practice, all operations performed in the evaluation unit 56A are carried out by the software of a microprocessor. In order to facilitate representation, a corresponding "hardware-solution" has been illustrated in FIG. 8 and will be described in the following.

The direct transmission is represented by the signal path (bypass) 91, while a second signal path comprises a low pass filter 89. A controllable switch 87 sends the signal x either to the bypass 91 or to the filter 89.

Switch 87 is controlled by a comparing element 93 which compares the instantaneous signal x with the immediately preceding delivered signal h (a store—not shown—for the signal h can be provided between the filter 89 and the comparing element 93).

When the element 93 detects that the signal x lies below the previously delivered signal h, or is equal thereto, switch 87 is controlled so that signal x is delivered to the bypass 91. On the other hand, if the element 93 detects that the signal x is higher than the previously delivered signal h, switch 87 is controlled so that the signal x is delivered to the filter 89.

The evaluation unit 56A therefor receives from the member 54 a signal which corresponds to the apparent level determined by the member 54. The unit 56A delivers a signal h which corresponds to the derived level. The output signal h of the unit 56A therefore changes as a function of the signal delivered by the member 54, the function itself being variable in dependence upon the "behavior" of the input signal. In the given example, this function is dependent upon how the instantaneous "signal level" of the input signal (in discrete values 0 to 8 of the signal x) behaves in relation to the previously derived output signal h. The function is adaptable in correspondence with the input signal between two forms (low pass filtering and unchanged further transmission), i.e. in one case the function corresponds to a 1:1 reproduction of the input signal.

The invention is, however, not limited to the form shown here by way of example. For example, it may prove advantageous to filter both a declining and an increasing input signal, possibly however with different limit frequencies. Where the derivation of the actual level necessitates a change of the signal x representing the apparent level, this modification can involve an operation other than filtering. For example, empirical values for the "genuine" significance of "level jumps" could be determined by experiment and entered into the programming of the evaluation unit. As a further modification, "average values" could be passed on the basis of several combined interrogation cycles.

Changes in the processing function could be generated in response to changes in the input signal alone, instead of by changes in the input signal in comparison to the output signal (but it would then be necessary to change the filtering operation correspondingly). The main difference in relation to the given example would be noted in the behavior of the system upon (slow) decline from a peak in the apparent level, e.g., in the cycles 4, 5 and 6 in FIG. 6, in that the declining tendency alone suffices to set the unchanged transmission of the input signal back into effect. The function can take on more than two forms, but additional forms would have to bring significant advantages in order to justify the corresponding complications.

In general, the optimal evaluation can be determined empirically (through observation of the reaction of the system to various level variations). The evaluation should, however, in any event recognize an increasing tendency in its input signal and pass this on only in a modified fashion.

In the comparison element "comparator" 56B (FIG. 3) the derived height represented by the signal h is compared with a predetermined set height, and an output signal e is delivered to represent possible deviation. This output signal comprises two components, namely a direction component ± and a magnitude. The signal is processed by the regulating algorithm of the microprocessor 58A, as will subsequently be described in connection with FIGS. 9 and 10. Previously, however, certain possible operating conditions of the regulating length will be explained.

ZONES WITHIN THE COMPLETE MEASUREMENT REGION

The control unit preferably operates during normal production operation without intervention of the operating personnel. This means that the control unit is not provided with any information about set production levels for the card (or other machine to be supplied with material). The control unit must therefore function even when at the start of its operation the main chute 40 (FIG. 1) is completely empty (startup). Furthermore, the control unit is designed not only to absorb general variations during normal operation, but also compensates the effects of a new setting of the card production carried out by the operating personnel.

These various operating conditions are of course to be taken into account in the design of the overall system. For this purpose, it would be possible to permit various "setting conditions" to be fed into the control system as guide quantities. Advantageously, however, the system is so designed that it operates in a "selfregulating" manner during normal production operation, i.e. that it can find its own level again regardless (within certain limits) of how the preceding and subsequent machines are set.

In order to enable this, the control algorithm (the control function) itself is defined as a variable function of the deviation from the set level. The change in the control algorithm can be carried out in steps so that the measurement region defined by the height measurement device is divided into several zones, each zone having associated therewith a predetermined control algorithm. The control algorithms of neighboring zones are always different, but non-adjacent zones may be allocated the same algorithms.

A corresponding division of the measurement region is illustrated schematically in FIG. 9. The vertical line corresponds to the complete measurement region covered by the height measurement device. The transverse lines NAZ max and NAZ min correspond to the upper and to the lower limits of a "normal operating zone", i.e. during normal operation, level variations within this zone must be expected. A first ("normal") control algorithm is allocated to this zone. The section above the normal operating zone (NAZ) is designated as the upper operating zone (OAZ) and is associated with the second control algorithm for the purpose of rapid reduction of the accumulating flocks. An overfill safety device (not illustrated) is provided above the upper end of the operating zone OAZ to switch off the feed of flocks in the event that the control system is not longer able to cope with the rate of increase in the column height.

The transverse line NP represents a "relative zero point" so that a lower operating zone UAZ is defined between point NP and point NAZ min. This operating zone UAZ is associated with a control algorithm different from the algorithm for zone NAZ. The algorithm for the lower operating zone can be the same as that allocated to the upper operating zone or can be different therefrom.

Beneath the relative zero point NP there is a "emptying zone" (LZ) which has associated therewith a further algorithm differing from that of the lower operating zone UAZ. Normally, the instantaneous column height should only be located within (or below) the emptying zone LZ if the chute is being filled (a new start to operation) or emptied. The corresponding control algorithm can be so defined that an especially rapid filling of the chute takes place when flock feed is controlled in accordance with this algorithm. In order to permit emptying of the chute, the flock feed can be switched off so that the closed loop is no longer capable of compensating the flow of material from the lower end of the chute by additional feed from above.

The transverse line SN represents the set level which of course lies within the normal operating zone NAZ. By evaluation of the two components (magnitude and direction) of the deviation signal e, it is possible to determine in which zone the instantaneous derived level (represented by the signal h) is located.

As already indicated by the word "algorithm", the processing of the deviation signal to a set-revolution' signal will currently be carried out by a microprocessor. A flow diagram for corresponding routines in the programming of this microprocessor is shown in FIG. 10.

Box 100 in FIG. 10 represents an initial setting step which must be carried out upon fresh starting up of the chute or control system in order to determine the starting conditions. By means of this step, a predetermined speed of the motor 34A (e.g. 30 to 50% of the maximum speed of the motor) is automatically set into the system.

At this stage of the description, the steps indicated with dotted lines will be temporarily ignored, i.e., it will be assumed that the system precedes directly to the determination of the instantaneous height (or level) represented by the box 102. In accordance with the step represented by box 104, a determination is made as to whether the instantaneous height is greater than the maximum height (NAZ) of the normal operating zone, i.e. whether the instantaneous height is in or above the upper operating zone OAZ. In the latter case, the deviation signal is processed in accordance with a first control algorithm A1, as indicated by box 106 in FIG. 10. By means of this step, a new basic speed (set-speed) of the motor 34A is defined, and the corresponding data are stored, the latter step being illustrated by the box 108.

The stored value is now delivered in the form of a set-speed signal N (box 110). After expiry of the total interrogation time (the interrogation cycle), as indicated by the box 112, the routine returns to the new determination of the instantaneous height (box 102) or to the steps indicated by the dotted lines, these latter being dealt with later in this description.

In the event that the step 104 indicates that the instantaneous height is not within or above the upper zone OAZ, step 114 will determine whether the instantaneous height lies within the normal operating zone (between the normal maximum and minimum heights NAZ max, NAZ min respectively). In this case, the deviation signal will be processed in accordance with a second control algorithm A2 (box 116) in order to determine the new basic rate of revolutions, the routine then running through the previously described steps 108, 110 and 112.

In the event that step 114 determines that the instantaneous height lies below the normal minimum height NAZ min, then the final switching step 118 will determine whether the instantaneous height lies within the lower operation zone UAZ, i.e. between the normal minimum height NAZ min and the zero point NP. In this case, the deviation signal will be processed in accordance with a third control algorithm A3 (box 120), following which the process proceeds to the steps 108, 110, 112. If step 118 determines that the instantaneous height is below the zero point, that is within or below the emptying zone LZ, then the deviation signal is processed in accordance with A4 control algorithm (box 122) in order to determine the new basic speed.

As example, the following control algorithms are suggested:

A1: $N=SO+Fo.e-Exo$
A2: $N=SO+FN.e$
A3: $N=SO+Fu.e+Exu$
A4: $N=Fl(t)$,

The various symbols having the following meanings:

SO—instantaneous basic speed
N—set speed for the feed roll motor 34A
e—Height difference ("deviation" - set-height minus instantaneous height)
OF—control parameter for the upper operating zone OAZ
FN—control parameter for the normal operating zone NAZ
Fu—control parameter for the lower operating zone UAZ
Fl(t)—a control characteristic for the emptying zone LZ
Exo—an additional reduction when the speed is clearly to high
Exu—an additional increase when the speed is clearly to low.

The control unit therefore operates normally in accordance with a control algorithm of the general form: $N=e.F+SO$, the control parameter F being different from zone to zone. Advantageously, the controller operates as a PI-controller and then the control parameter F can be represented by the relationship $F=K(1+TO/TN)$, the control algorithm being adapted to the various operating conditions by adjustment of the components K and Tn.

Advantageously, the control parameter FN is independent of the magnitude of the deviation e within the normal operation zone NAZ, so that the components K and Tn can be determined as constants for this zone. In the upper and lower operating zones OAZ and UAZm, on the other hand, the respective control parameters OF and FU can be set proportional to the deviation e by corresponding adaptation of the components K and Tn, i.e., in these zones K and/or T is a function of e.

When the instantaneous height no longer lies below the zero point NP, the set speed N is no longer determined by processing of the deviation signal e but directly from a characteristic Fl(t). The symbol t indicates that the set speed N is a function of time so that the set speed N becomes higher the longer the instantaneous height remains below the zero point NP. The characteristic itself can be made dependent upon the basic speed and or the rate of fall, for example, the slope of the characteristic can be adjusted as function of one or both of these parameters.

The microprocessor switches in a time measuring procedure when the instantaneous height sinks from the lowering operation zone UAZ into the emptying zone LZ and the determination of the set speed N is made dependent upon the subsequent measured time in accordance with characteristic Fl(t). If this time measurement procedure is not stopped within a predetermined interval by the return of the instantaneous height into the lower operating zone UAZ, then the microprocessor emits a defect signal "chute empty" whereupon the card can be switched off. A corresponding time measurement procedure can be used to determine the previously mentioned rate of fall, the running time involved in the decline of the instantaneous height through predetermined intervals within the lower operating zone being measured, whereafter for example the slope of the mentioned characteristic can be appropriately adapted.

ADDITIONAL MEASURES

The additional steps indicated by dotted lines in FIG. 10 will now be described. The switching step 124 can determine whether the card is operating with a normal speed SO=Sn or a "crawl speed" SO=SK. If the card is operating with a normal (production) speed, then the control operates as already described. However, the card is sometimes, (for example during piecing up of a sliver break) switched over to a low (crawl) speed in order to facilitate the service operation. When this condition applies, the switching step 124 can effect the replacement of the normal basic speed SN by a "crawl-speed" SK. The instantaneous basic speed SO) used to determine the set value N can then be adapted in one step to a value corresponding to the crawl speed of the card. This enables avoidance of oscillations in the column height over a certain period following switching over to crawl speed.

When the card is returned to a normal production speed, the crawl speed SK can be replaced by the last stored value of the normal basic speed SN. This measure enables the elimination of a defect which would otherwise be generated by operating conditions which are predictable but which are outside the normal machine operating procedure.

A similar purpose is served by the arrangement shown in FIG. 11, which provide for a so-called disturbance magnitude compensation. The closed loop illustrated in FIG. 3 influences only the speed of the feed rolls 32, which should in turn lead to a change in the material flow MFe. This material flow is, however, dependent upon other magnitudes, for example upon the density of the material stored in the chute 24. In order to eliminate disturbances caused by density variations, the lift of the feed rolls 24 can be measured by appropriate means (not shown), a corresponding signal S (FIG. 11) can be generated, and can be combined with the signal generated by the microprocessor 58A in order to give a "clear" value N. The signal i (FIG. 11) representing the mentioned lift can, for example, be processed by formation of the reciprocal value (box 126 in FIG. 11) and the output signal of the device 126 can be adapted by a proportional factor in the device 128 to form the signal S. Signal S can then be multiplied with the output signal of the microprocessor 58A. If a linearising function can be built into the formation of the signal S, then the multiplication operation 130 (FIG. 11) can be replaced by an addition operation.

FIG. 12 shows the preferred arrangement of light barriers in order to cover a complete measurement region in an optimum manner. This complete region is again represented, as in FIG. 9, by a vertical scale. The length of this scale is indicated as 150mm by way as example, but the arrangement is not limited to this specific example. The transverse lines on the scale represent the positions of the individual light barriers, these barriers being identified from lower to upper end of the row by the numbers 1 to 8. In this arrangement, light barrier number 4 represents the set height or level, which can be located, for example, 95mm from the lower end of the scale (0 mm). This figure shows that the light barriers above and in the immediate vicinity of the set height are separated from each other by a relatively small spacing A (in this example, 10mm) and in that the corresponding spacing increases in the upward and downward direction. The precise spacings are quoted only as examples to explain the principle of the increasing spacing.

The sensor arrangement according to FIG. 12 can be divided into zones in accordance with FIG. 9 in the following way:

zone LZ—below sensor 1
zone UAZ—sensor 1 to below sensor 2
zone NZ—sensor 2 to below sensor 7
zone OAZ—sensor 7 to below sensor 8
(overfill safety device—above sensor 8)

The "sensor density" is highest in the normal operating zone. Furthermore, there is a relatively high "density" immediately about the set height. The concentration of sensors in the zone NAZ is intended to ensure the maintenance of the instantaneous level within this zone. The higher concentration about the set height is advisable because of two facts:

firstly, because the control system can not influence the outflow of fiber material from the chute, so that a tendency to overfill is more critical for the control system than a tendency to run empty, secondly, because the set height is in any event set as high as practically possible and a tendency to overfilling must therefore be opposed; this is assisted by the additional information (finer division of the measurement region above the set height).

The suggested arrangement has the objective of an optimal exploitation of a limited number of sensors. The mentioned goals can clearly be obtained by increasing the number of sensors, but this would lead to a substantial increase in total costs (not only for the sensors themselves, but also for the subsequent elements for processing of signals).

According to a further variant, schematically illustrated in FIG. 13, the filtering step (FIG. 8) can be replaced by a signal delay means. FIG. 13 again represents a hardware-solution, although in the current practice a software solution by programming a microprocessor would be preferred.

FIG. 13 shows time delay elements V1 to Vn between the inputs E1 to En (only three inputs shown) and an evaluation stage 88A, which performs the same operation as the input stage 88 of the variant shown in FIG. 8, namely the determination of the number of light barriers between the lower end of the row and lowest free light barrier in the row.

Each element V1 to Vn is associated with a respective bypass U with two switches S. Each switch S responds to a signal change in the sense of "releasing" of the corresponding light barrier by passing the signal from the respective output of the shift register 76 via the respective bypass U to the evaluation stage 88A, i.e. without a time delay. In the case of a signal change in the sense of "blocking" of the corresponding light barrier (by flocks), the switches S respond in such manner that the signal from the respective output of the shaft register 76 is passed to the respective delay element V1 to Vn, and only then after elapse of a predetermined time delay to the evaluation stage 88A.

The effect of this arrangement is that "release" is communicated immediately to the evaluation stage while "blocking" only arrives after a delay. This means that an "increase" in the apparent level can only exert an effect at stage 88A after a certain delay but a "decrease" has an immediate effect on the apparent level.

A temporary increase in the apparent level with a duration shorter than the predetermined delay therefore has no influence on the value derived by the evaluation stage 88A, because the (subsequent) "decrease" arrives at the stage 88A simultaneously with or even earlier than the "increase". Stage 88A delivers an output signal hl which takes account of only the lowest free light barrier in the row.

Furthermore, if a change in the sense of "blocking" appears on one input, e.g. E1, but is overtaken by a signal change in the sense of "release" on the same input before the expiry of the predetermined delay, then the "blocking" change has no effect whatsoever on the stage 88A, because the "release" resets both the switches and the time delay element and this fully suppresses the "blocking" change. Each element V1 to Vn can be designed as a counter which is initiated to count clock pulses by a signal change in the sense of a block. The counter issues an output signal after a predetermined number of clock pulses have been registered.

The elements V1 to Vn may have different time constants, shorter delays (approx 1 second) being advantageous in the neighborhood of the set level and longer delays (2–3 second) towards the ends of the row.

An overfill safety feature can be provided in response to a "chute full" signal (all light barriers "blocked") in that an element US issues a stop signal after a predetermined time delay. If, within this delay, the "chute full" signal disappears from the output of stage 88A, element US is reset and no stop signal is issued.

In general, it has proved advantageous to respond to a falling level with an intensity different from that of the response to a rising level. Two (or more) different control algorithms can therefore be allocated to one zone of the measurement region (FIG. 9/10), the one being effective in the case of a falling level and the other in the case of a rising level. Sinking or rising of the level can be determined by comparison of the instantaneous derived value with a previously stored value and the corresponding control algorithm can be selected. Above the set level, reaction to a rising level may be relatively strong (in a sense reducing revolutions) and to a falling level relatively weak (also reducing revolutions). Below the set level, reaction to a rising level may be relatively weak and to a falling level relatively strong, in both cases in a sense increasing revolutions.

From these remarks it will be clear that the reaction in the neighborhood of the set level should be relatively weak and further away from the set level should be relatively strong. A base rate of revolutions No can therefore be defined for the feedrolls(s). Above the set level, the instantaneous set speed N for the regulator is given by $N=No-\Delta N$ and below the set level by $N=No+\Delta N$, where $\Delta N$ is a function of the deviation from the set level and this function is different for falling and rising level trends.

MODIFICATIONS

The invention is not limited to the details of the illustrated embodiments. In particular, it is not dependent upon the use of light barriers. Other sensors, for example Ultrasonic transmitter/receiver-units could be used. Where the instantaneous height has to be determined by light beams (which in this context includes the infrared- and UV-regions), it is not essential to use "discrete" signals (generated by individual sensors). The instantaneous height could, for example, be determined by a so called image analyzer of the complete measurement region. Where individual sensors are used, the arrangement (array) can be more complex than the simple row shown in the described example. The complexity must, however, clearly bring a corresponding advantage, for example higher precision through determination of an average value.

The sensors of the height measuring member should as far as reasonably possible have the same sensibility. In combination with a chute depth (spacing transmitter - receiver or transmitter - reflector) of approx. 190mm, the member can be so arranged that a 30% greyfilter does not interrupt the beam (minimal beamrange of 350 mm). Each receiver unit can be provided with its own amplifier and threshold element.

The derived height values in the described embodiments are digital values, i.e. the system can only take account of predetermined, coded height values. They are also discontinuous values, because they are determined in accordance with a periodic interrogation cycle. If the sensors are continuously switched on, which requires an adjusted evaluation unit, then corresponding continuous digital values can be derived and taken into account by the control unit.

The use of analog signals is not excluded, but normally it will be simpler to generate digital values. For example, in the case of an image analyzer embodiment the instantaneous height could be determined by means of a Scanner.

As another possibility, pneumatic sensors could be used, for example could be arranged in the chute wall. The air throughput through small jets could be exploited to determine the instantaneous height.

In comparison with the state of the art (pressure control system, for example in accordance with German Patent Specification No. 2658044) a level control system in accordance with this invention has the following advantages:

a condensing device (fan) is not necessary to build up the necessary operating pressure in the main chute portion (in FIG. 1, chute portion 40); there is no preliminary compression of the feedstock in the chute (such preliminary compression must be relaxed again before infeed into the care, and this necessitates large, uncontrolled drafts; furthermore the condensed material column reacts very sensitively to small level variations so that a high precision of control is necessary to avoid spin-technology disadvantages)

the level control system is based upon direct determination of the relevant magnitude (height of the batt) instead of an indirect determination of operating pressure (or air quantity); the level control system therefore avoids confusing effects such as possible dependence of operation pressure on material type the control system does not require any air guiding members which could prejudice operating reliability because of clogging or fouling the control system does not require any essential information from the card; the chute can therefore produce a perfect batt independent of the card type associated therewith.

What is claimed is:

1. In combination a feed chute for a fiber processing machine including an infeed chute for receiving fiber blocks, forwarding means for forwarding fiber flocks from said infeed chute and a main chute for forming a flock column of the fiber flocks forwarded from said infeed chute; and a control means for controlling said forwarding means in dependence upon the flock column in said main chute, said control means including first means for defining a set height of the fiber column in said main chute, a plurality of sensors distributed along a vertical line and adapted to react to the material in an operating region adjacent thereof, an interrogation device for interrogating said sensors in sequential manner to obtain a signal indicative of the height of the flock column, and second means for determining a magnitude of a deviation of the indicated height of the fiber column from said set height, said second means being connected to said forwarding means to control said forwarding means in response to a determined magnitude of deviation to eliminate the deviation.

2. The combination as set forth in claim 1 wherein said forwarding means includes a feed roller.

3. The combination as set forth in claim 1 which further includes an evaluating unit connected to said interrogation device to receive signals therefrom and to emit a signal therefrom representing an instantaneous actual column height.

4. The combination as set forth in claim 3 wherein said evaluating unit is connected to said interrogation device to receive said signals therefrom as input signals and for emitting a level dependent signal as a function of said input signal, said evaluating unit including filter means to receive said level dependent signal and by-pass means for by-passing said level dependent signal about said filter means in response to said level dependent signal having a rising tendency.

5. The combination as set forth in claim 4 which further comprises a plurality of delay means, each delay means being connected between a respective sensor and said evaluating unit to receive an apparent height signal from a respective sensor, and a plurality of by-pass means, each by-pass means being connected in parallel with a respective delay means to by-pass an apparent height signal from a respective sensor in response to a decreasing tendency of the column height.

6. The combination as set forth in claim 3 wherein said second means includes a comparator for comparing said actual column height signal with a predetermined height to generate a control signal for emission to said forwarding means.

7. The combination as set forth in claim 3 wherein said sensors are distributed above and below said set height and said evaluation unit is programmed to emit one signal corresponding to a rising level of the fiber column above said set height for reducing the rate of forwarding of fiber flocks from said infeed chute and a second signal corresponding to a decreasing level of the fiber column for reducing said rate of forwarding by a lesser amount.

8. The combination as set forth in claim 1 wherein each sensor directs a light beam transversely across said main chute and responds to interruption of said beam by fiber flock in said main chute.

9. A measuring member the combination as set forth in claim 1 wherein said interrogation device is disposed for sequential switching of said sensors in accordance with a predetermined interrogation cycle.

10. The combination as set forth in claim 9 wherein said sensors are light beam emitting sensors.

11. The combination as set forth in claim 1 wherein said sensors are distributed in a row along said line.

12. A device for generating a level dependent signal comprising a member for responding to a level of material and for delivering a first signal corresponding to the level of material determined; and an evaluation means connected to said member to receive said first signal and for emitting a level dependent signal as a function of said first signal over time said function having a first form in response to a rising tendency of said first signal and a second form in response to a declining tendency of said first signal.

13. A device as set forth in claim 12 wherein said function is dependent upon the behavior of said first signal relative to a previously delivered level dependent signal from said evaluation means.

14. A method for feeding a uniform bat to a fiber processing machine comprising the steps of feeding fiber flock into a chute at a predetermined rate to form a column of the fiber flock in the chute;

sequentially interrogating a vertical row of sensors disposed along the chute to obtain a sequence of signals therefrom each indicative of an apparent height of the column of fiber flock;

processing each apparent height signal to form a derived signal indicative of the actual height of the column of fiber flock, said processing step including evaluation of each apparent height signal with a preceding derived signal to form a further derived signal indicative of the detected height of the column of fiber flock;

comparing each derived signal indicative of the detected height of the fiber flock column with a set height to generate a control signal in dependence on the deviation of the detected height from said set height; and changing the rate of feed of the fiber flock into the chute in dependence on said control signal.

15. A method as set forth in claim 14 wherein the height of the fiber flock column is detected along a vertical line.

16. In combination a feed chute for a fiber processing machine including an infeed chute for receiving fiber flocks, forwarding means for forwarding fiber flocks from said infeed chute and a main chute below said forwarding means for forming a flock column of the fiber flocks forwarded from said infeed chute; and a control means for controlling said forwarding means in dependence upon the flock column in said main chute, said control means including a first means for defining a set height of the fiber column in said main chute spaced between 100 and 400 millimeters from said forwarding means; and second means for determining the magnitude of a deviation of the actual fiber column height from said set height, said second means being connected to said forwarding means to control said forwarding means in response to a determined magnitude of deviation to eliminate the deviation.

17. The combination as set forth in claim 16 wherein said second means includes a measuring member for reacting to an instantaneous column height along a predetermined vertical line.

18. The combination as set forth in claim 17 wherein said measuring member includes a row of sensors distributed along said vertical line, each sensor reacting to fiber material in an operating region adjacent said sensor.

19. A measuring member for determining a level of a flowable material comprising a plurality a sensors distributed in a row along a vertical line, said sensors being spaced at small spacings in an intermediate region of said row and at larger spacings in at least one end region of said row, each said sensor being adapted to react to the material in an operating region adjacent said sensor; and an interrogation device for interrogating said sensors to determine whether material is present or not in each respective operating region.

20. A measuring member as set forth in claim 19 wherein said interrogation device is disposed for sequential switching of said sensors in accordance with a predetermined interrogation cycle.

21. A measuring member as set forth in claim 20 wherein said sensors are light beam emitting sensors.

22. A device for generating a level dependent signal comprising a member for responding to a level of material and for delivering a first signal corresponding to the level of material determined; and an evaluation means connecting to said member to receive said first signal and for emitting a level dependent signal as a function of said first signal over time, said evaluation means including a low pass filter for filtering said first signal in response to a rising tendency of said first signal.

23. A method of detecting the height of a column of fiber flocks in a chute receiving a supply of fiber flocks; said method comprising the steps of disposing a vertical row of sensors along the chute with each sensor being capable of emitting a signal corresponding to the apparent presence of the flock column thereat;

sequentially interrogating the sensors to obtain a sequence of signals therefrom corresponding to the apparent height of the flock column; and evaluating each apparent height signal of said sequence of signals to form a derived signal indicative of the detected height of the flock column.

24. A method as set forth in claim 23 which further comprises the step of comparing each apparent height signal with the immediately preceding derived signal to form a further derived signal indicative of the height of the fiber column.

25. A method as set forth in claim 24 which further comprises the step of filtering an apparent height signal in response to said apparent height signal being greater than the immediately preceding derived signal to form a further derived signal indicative of the height of the fiber column.

26. A method as set forth in claim 24 which further comprises the steps of detecting one of an increasing tendency and a decreasing tendency in the value of a sequence of apparent height signals and filtering said apparent height signals in response thereto.

27. A method as set forth in claim 26 wherein said filtering is a low pass filtering.

28. A method as set forth in claim 24 which further comprises the steps of detecting an increasing tendency in the value of a sequence of apparent height signals and filtering said apparent height signals in response thereto.

29. A method of controlling the height of a column of fiber flocks in a chute, said method comprising the steps of forwarding fiber flocks into the chute via a forwarding means;

disposing a vertical row of sensors along the chute with each sensor being capable of emitting a signal corresponding to the apparent presence of the flock column thereat;

sequentially interrogating the sensors to obtain a sequence of signals therefrom corresponding to the apparent height of the flock column; and evaluating each apparent height signal of said sequence of signals to form a derived signal indicative of the detected height of the flock column;

comparing each derived signal with a predetermined set height signal to form a control signal in response to a deviation therebetween; and controlling the forwarding means in dependence on said control signal.

* * * * *

UNITED STATES PATENT AND TRADEMARK OFFICE

CERTIFICATE OF CORRECTION

PATENT NO. : 4,939,816

DATED : July 10, 1990

INVENTOR(S) : THOMAS SCHENKEL,

It is certified that error appears in the above-identified patent and that said Letters Patent is hereby corrected as shown below:

Column 1, line 32 change "cute" to -chute-
Column 5, line 48 change "FIG." to -FIGS.-
Column 6, line 39 change "FIG." to -FIGS.-
Column 7, line 65 change "function As" to -function. As-
Column 9, line 36 change "therefor" to -therefore-
Column 10, line 22 change "+" to -+/-
Column 11, line 21 change "a" to -an-
Column 12, line 44 change "OF" to -FO-
Column 12, line 53 change "to" to -too-
Column 12, line 55 change "to" to -too-
Column 13, line 3 change "OF" to -FO-
Column 14, line 19 change "as" to -of- (second occurance)
Column 17, line 4 change "care" to -chute-
Column 18, line 23 cancel "A measuring member"; change "the" to -The-
Column 18, line 40 change "time said" to -time, said-
Column 18, line 55 change "therefrom each" to -therefrom, each-

Signed and Sealed this

Fourth Day of February, 1992

*Attest:*

*Attesting Officer*

HARRY F. MANBECK, JR.

*Commissioner of Patents and Trademarks*